US011578938B1

(12) United States Patent
Kim

(10) Patent No.: US 11,578,938 B1
(45) Date of Patent: Feb. 14, 2023

(54) DRUM MAGAZINE

(71) Applicant: Seung-Ho Kim, Goyang-si (KR)

(72) Inventor: Seung-Ho Kim, Goyang-si (KR)

( * ) Notice: Subject to any disclaimer, the term of this patent is extended or adjusted under 35 U.S.C. 154(b) by 0 days.

(21) Appl. No.: 17/717,269

(22) Filed: Apr. 11, 2022

(30) Foreign Application Priority Data

Dec. 2, 2021 (KR) ..... 10-2021-0170824

(51) Int. Cl.
*F41A 9/75* (2006.01)
*F41A 9/83* (2006.01)
*F41A 9/26* (2006.01)

(52) U.S. Cl.
CPC ..... *F41A 9/75* (2013.01); *F41A 9/26* (2013.01); *F41A 9/83* (2013.01)

(58) Field of Classification Search
CPC ..... F41A 9/26; F41A 9/73; F41A 9/74; F41A 9/75
See application file for complete search history.

(56) References Cited

U.S. PATENT DOCUMENTS 1,833,431 A * 11/1931 McCormick ..... F41A 9/73 42/19
2,321,720 A * 6/1943 Whittaker ..... F41A 9/73 89/33.02
4,332,097 A * 6/1982 Taylor, Jr. ..... F41A 9/73 89/33.02
4,413,546 A * 11/1983 Taylor, Jr. ..... F41A 9/73 89/33.02
8,220,377 B2 * 7/2012 Quetschke ..... F41A 9/75 89/33.02
2015/0219414 A1 * 8/2015 No ..... F41A 9/75 42/49.01
2016/0102931 A1 * 4/2016 Roberts ..... F41A 9/65 89/33.02

FOREIGN PATENT DOCUMENTS

DE 616095 C * 7/1935
DE 674452 C * 3/1939
KR 101220503 B1 * 1/2013
KR 10-1271650 6/2013
KR 10-1556380 10/2015
KR 10-2065856 1/2020

* cited by examiner

*Primary Examiner* — Gabriel J. Klein
(74) *Attorney, Agent, or Firm* — Lex IP Meister, PLLC

(57) ABSTRACT

The present invention relates to a drum magazine, and more particularly, to a drum magazine in which a wheel cover, which is configured to provide an elastic force via a main-spring to a bullet guide unit configured to elastically support a bullet loaded in a drum at a loading hole which is an inlet of the drum, is rotatably disposed at an outer surface of the drum, wherein, at the time of loading, an elastic latch unit is elastically engaged with an inner ring gear of the wheel cover and allows rotation of the wheel cover only in one direction so that a loading space at an entry of the loading hole that is provided due to arbitrary rotation of the wheel cover in the one direction is maintained as it is even when a user removes his or her hand from the magazine, and, after the loading is completed, a latch control unit configured to disengage the elastic latch unit and the inner ring gear is operated so that an elastic restoration force of the main-spring, which is accumulated due to the loading, is transmitted to the bullet guide unit and the loaded bullet is elastically supported at the loading hole.

5 Claims, 8 Drawing Sheets

[Fig. 1]
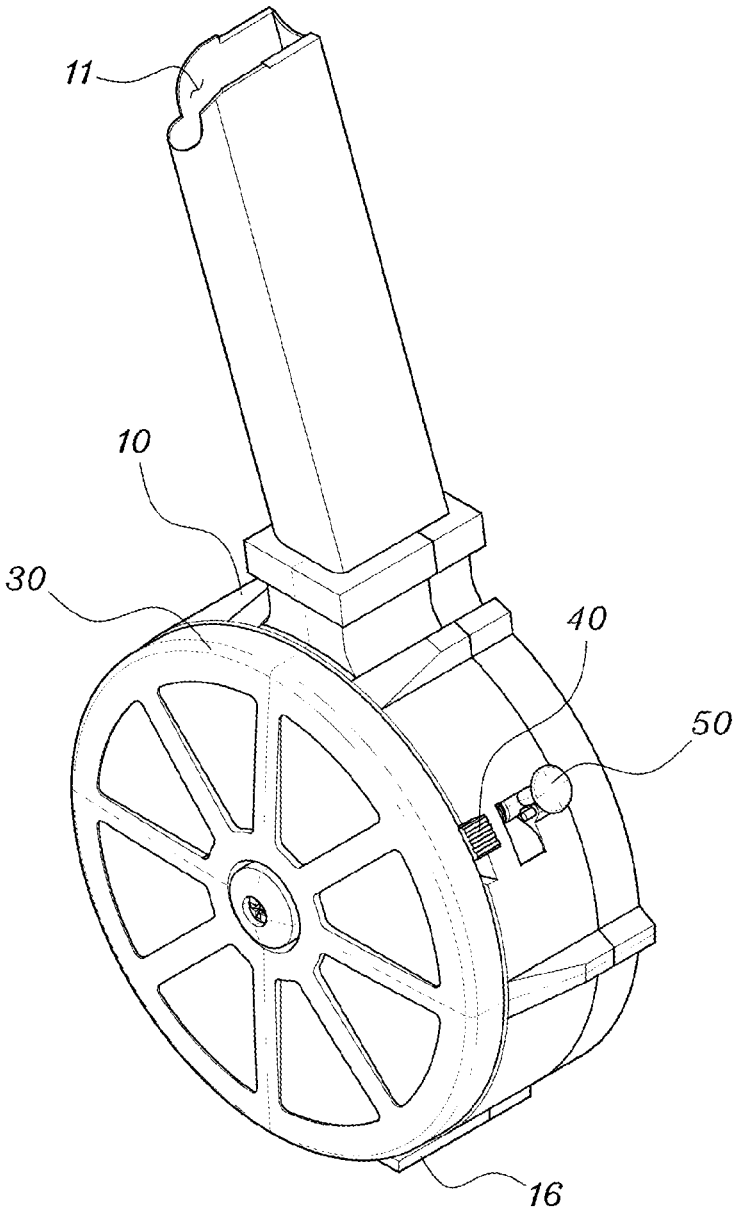

[Fig. 2]
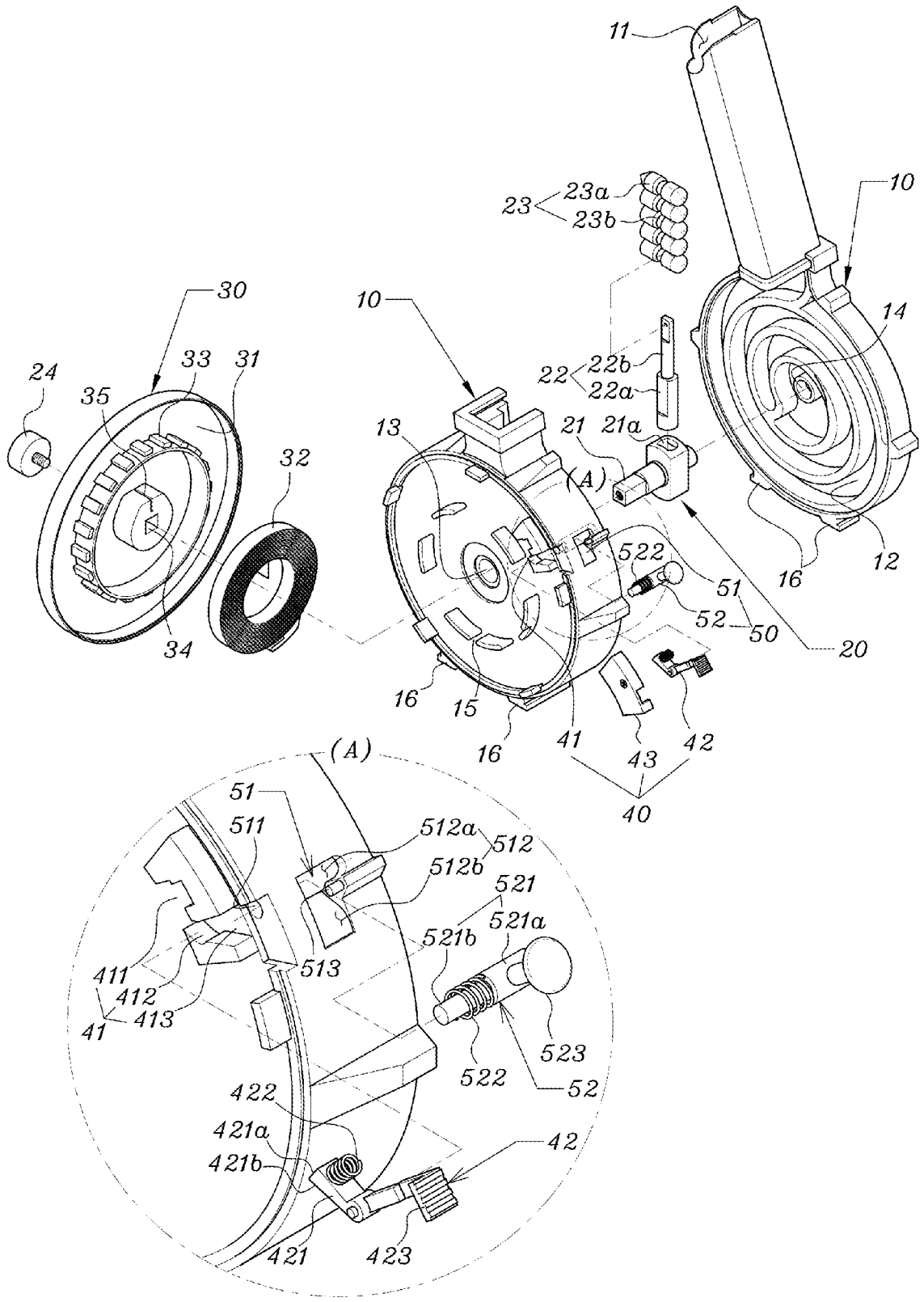

[Fig. 3]
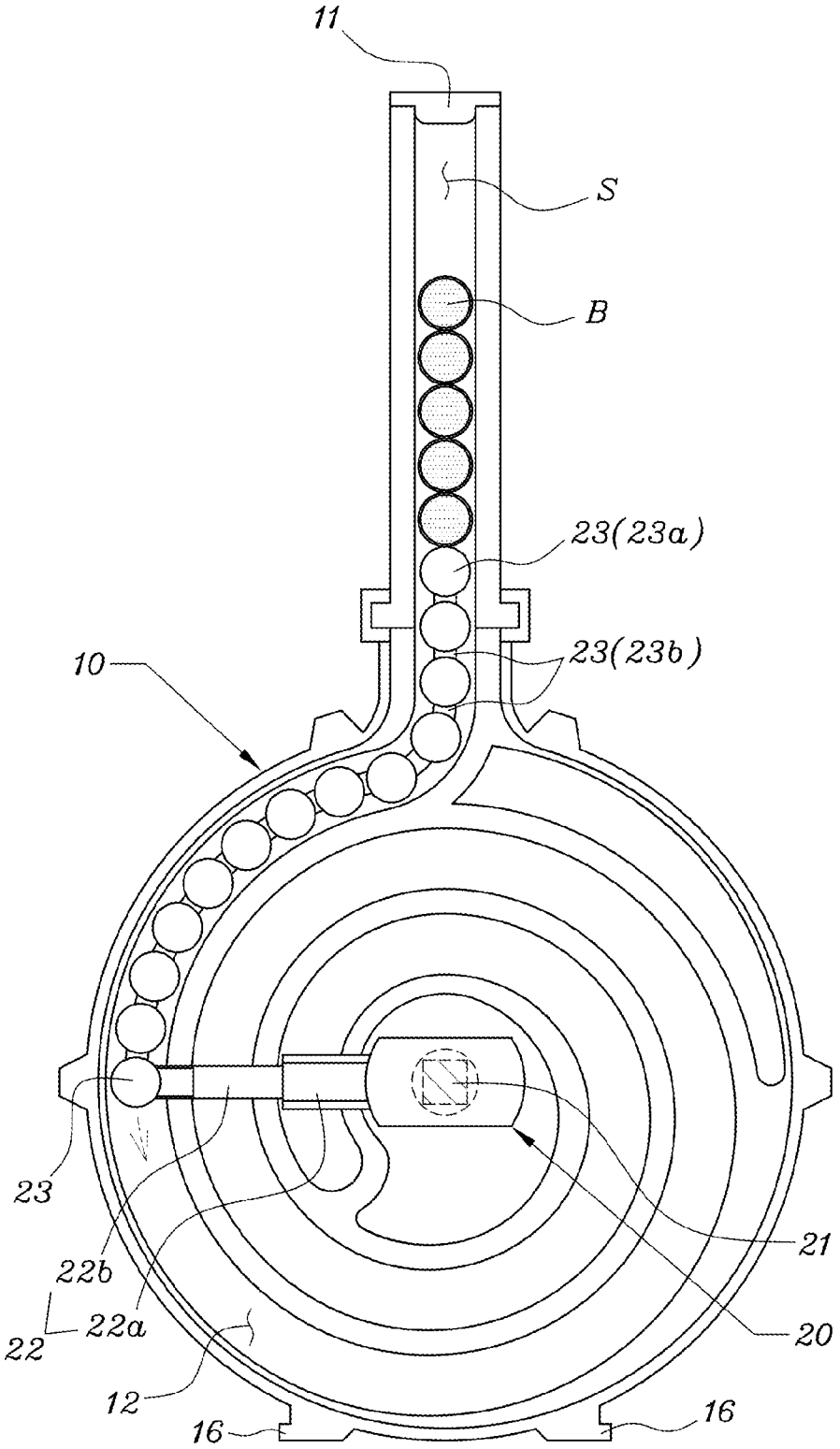

[Fig. 4]
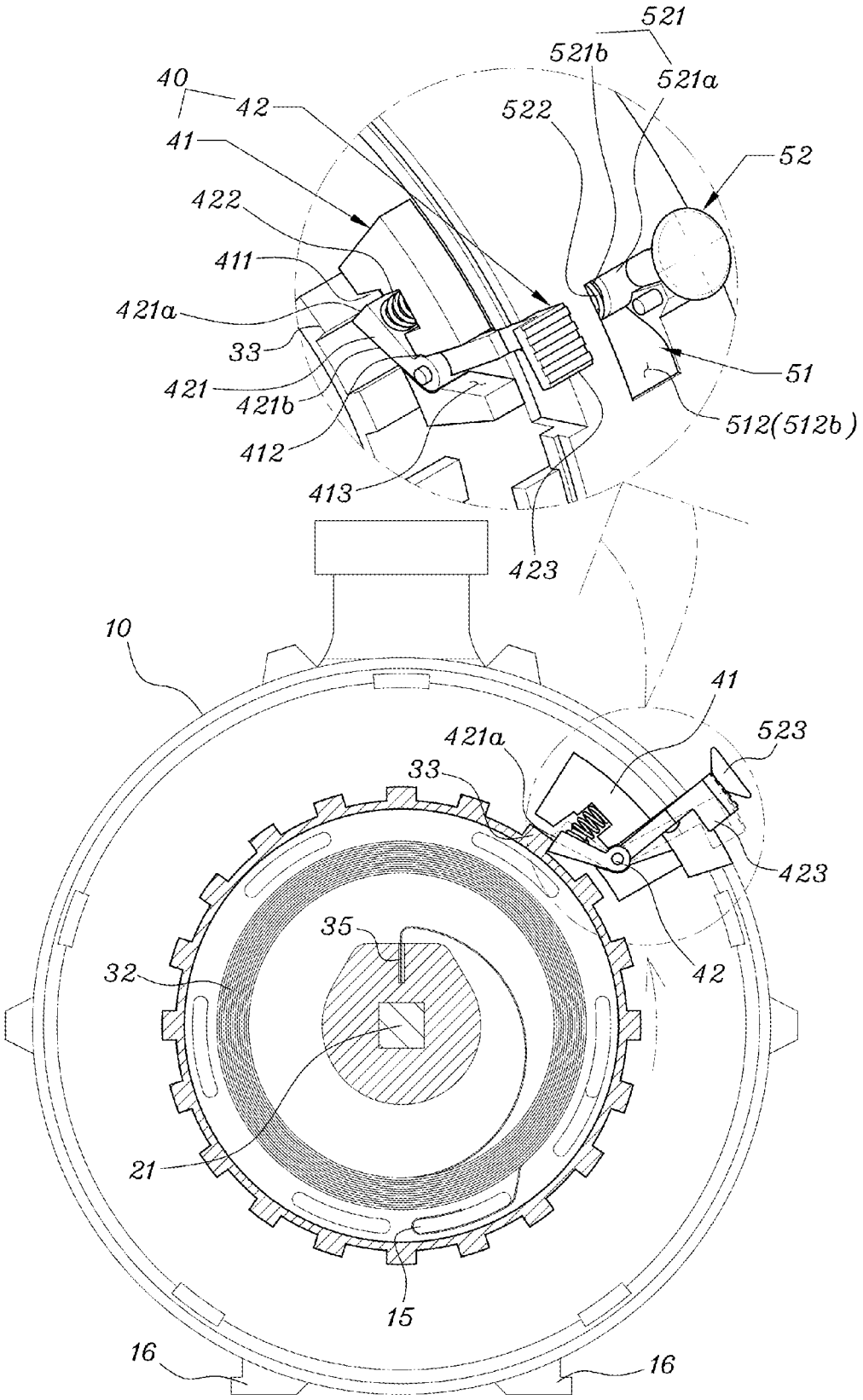

[Fig. 5]
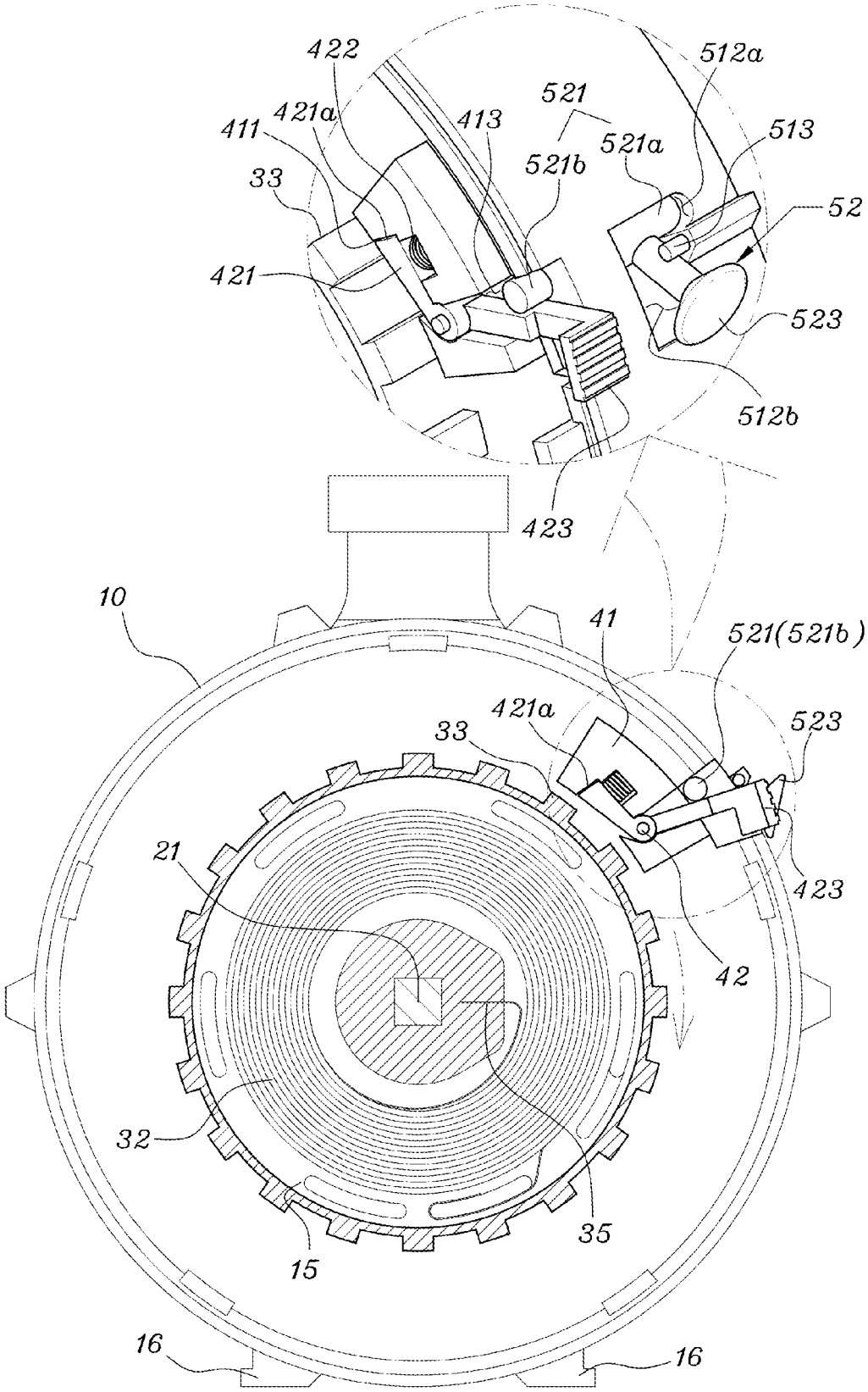

[Fig. 6]
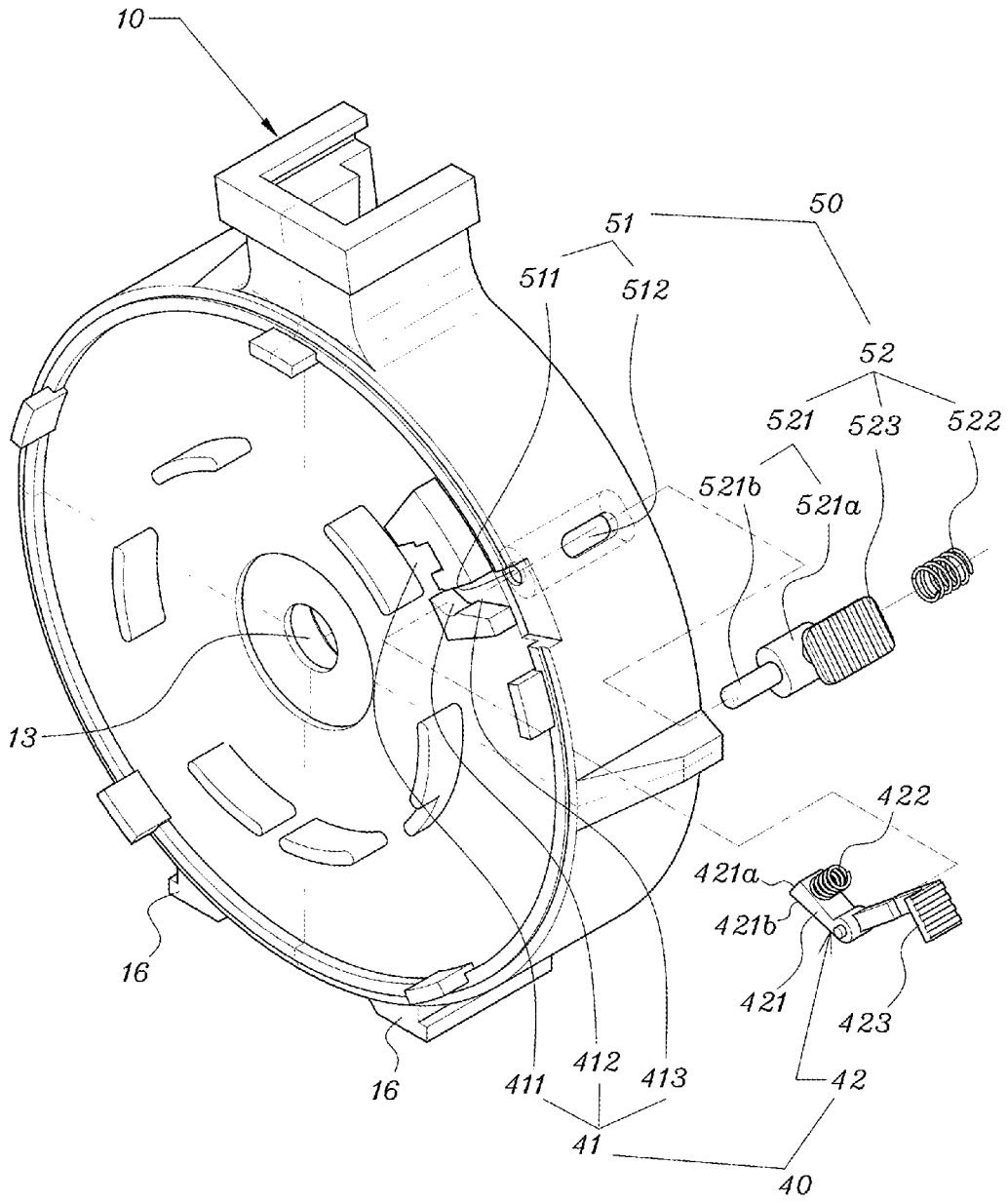

[Fig. 7]
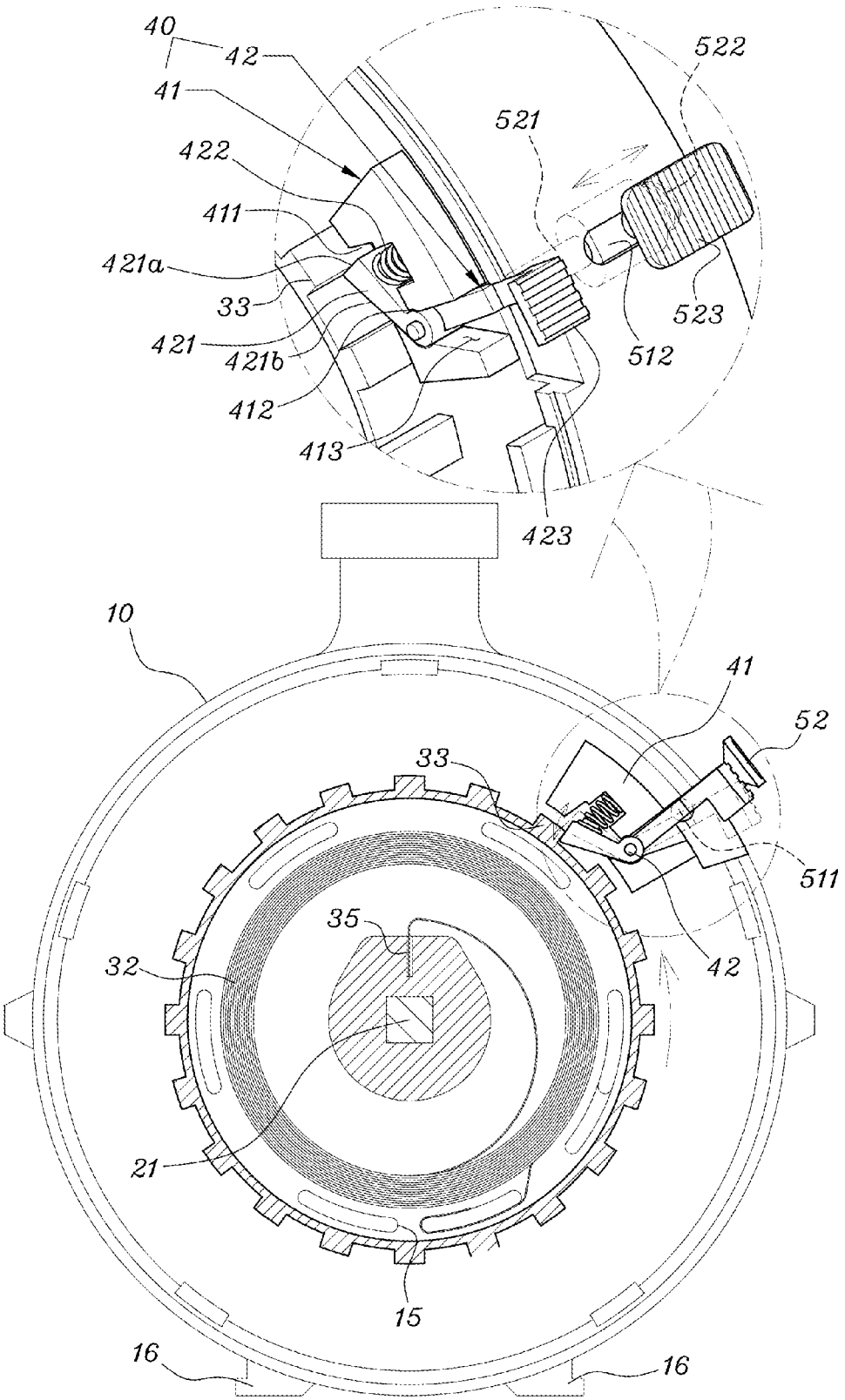

[Fig. 8]
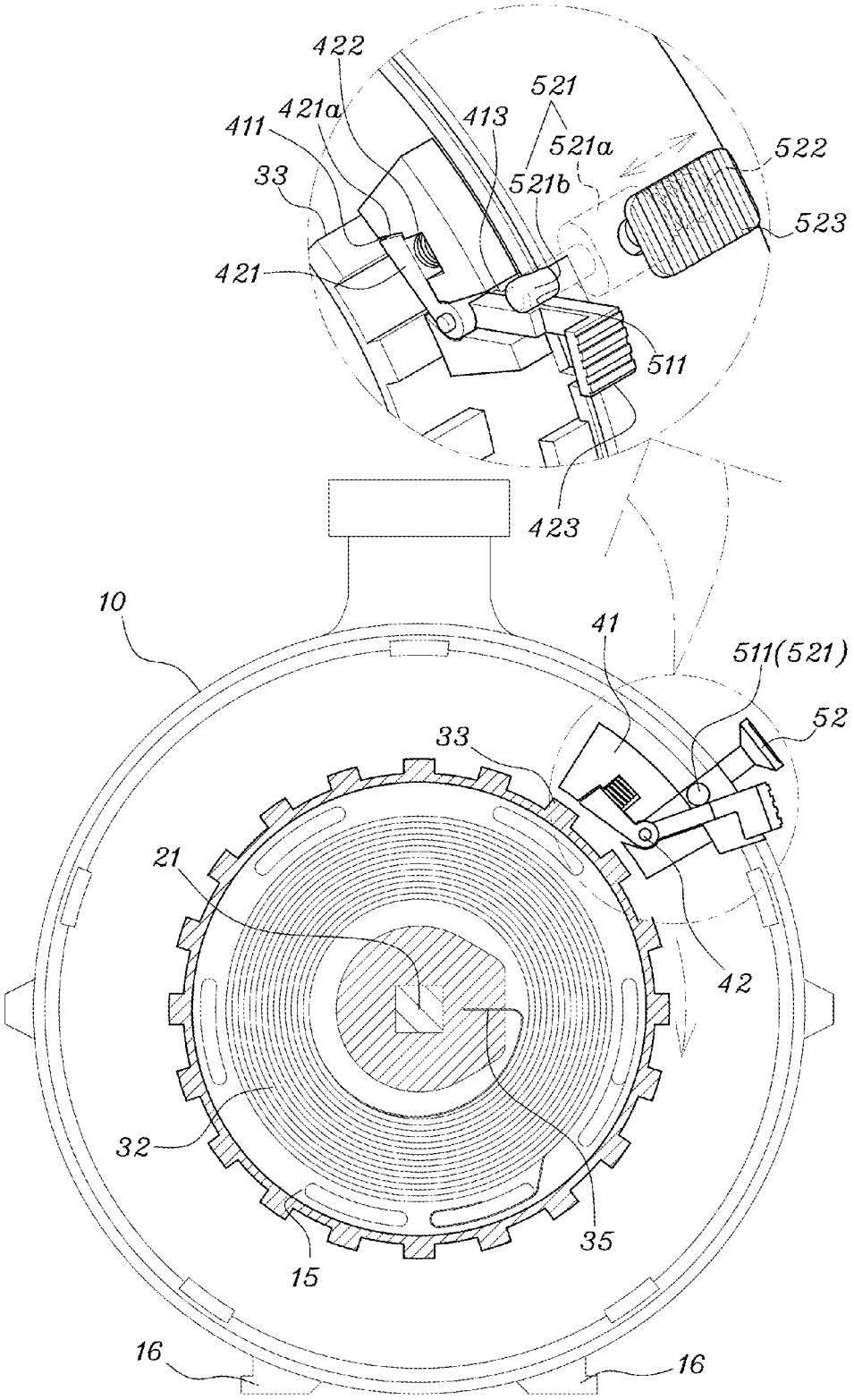

DRUM MAGAZINE

TECHNICAL FIELD

The present invention relates to a drum magazine, and more particularly, to a drum magazine in which a wheel cover, which is configured to provide an elastic force via a mainspring to a bullet guide unit configured to elastically support a bullet loaded in a drum at a loading hole which is an inlet of the drum, is rotatably disposed at an outer surface of the drum, wherein, at the time of loading, an elastic latch unit is elastically engaged with an inner ring gear of the wheel cover and allows rotation of the wheel cover only in one direction so that a loading space at an entry of the loading hole that is provided due to arbitrary rotation of the wheel cover in the one direction is maintained as it is even when a user removes his or her hand from the magazine, and, after the loading is completed, a latch control unit configured to disengage the elastic latch unit and the inner ring gear is operated so that an elastic restoration force of the mainspring, which is accumulated due to the loading, is transmitted to the bullet guide unit and the loaded bullet is elastically supported at the loading hole.

BACKGROUND ART

Generally, a drum magazine is configured to have bullets spirally loaded in a drum and has an advantage of being able to store a large amount of bullets.

Such drum magazines have already been introduced (for example, in Korean Patent Registration No. 10-2065856 (Title of Invention: Drum magazine; Date of Registration: Jan. 7, 2020).

In the related art, a handle manipulation part is installed on one surface of an outer portion of a main body portion, which is a drum. The handle manipulation part rotates in one direction and imparts an elastic force to a bullet guide member configured to elastically support a bullet at a loading hole inside the main body portion, and simultaneously causes an end portion of the bullet guide member to retreat from the loading hole to provide a loading space, in which a bullet may be loaded, at an entry of the loading hole. Also, the handle manipulation part is configured to maintain a rotated state when rotated by a predetermined angle once in one direction using a lever manipulation part.

In other words, in order to maintain the rotated state of the handle manipulation part that is rotated by the predetermined angle in the one direction, a user should continuously press the lever manipulation part to maintain an operating state. Then, when the user removes his or her hand from the lever manipulation part, the handle manipulation part rotates in the other direction on the basis of an elastic restoration force of a mainspring. The rotation of the handle manipulation part in the other direction is transmitted to the bullet guide member via a rotating shaft of a bullet guide part. Accordingly, the bullet guide member elastically supports the loaded bullet at the loading hole.

RELATED ART DOCUMENTS

Patent Documents (Patent Document 1) Korean Patent Registration No. 10-2065856 (Date of Registration: Jan. 7, 2020)

(Patent Document 2) Korean Patent Registration No. 10-1271650 (Date of Registration: May 30, 2013)

(Patent Document 3) Korean Patent Registration No. 10-1556380 (Date of Registration: Sep. 22, 2015)

DISCLOSURE

Technical Problem

When loading a bullet in the drum magazine of the related art, a user should keep pressing the lever manipulation part in order to maintain a rotated state of the handle manipulation part after rotating the handle manipulation part in one direction. The user should keep pressing the lever manipulation part while rotating the handle manipulation part in the one direction several times or several tens of times and loading bullets in the main body portion, which is a drum.

That is, in the related art, there is inconvenience in use that, when the pressed state of the lever manipulation part is not maintained after the handle manipulation part is rotated in the one direction and a certain space is secured as the loading space at the entry of the loading hole, the handle manipulation part rotates in the other direction due to the elastic restoration force of the mainspring, causing the loading space provided at the entry of the loading hole to disappear.

The present invention is directed to providing a drum magazine in which a wheel cover is installed on one surface of an outer portion of a drum to provide an elastic restoration force toward a loading hole to a bullet guide unit inside the drum through rotating in one direction, wherein, even when a user removes both hands from the drum magazine after rotating the wheel cover by an arbitrary angle in one direction, rotation of the wheel cover in the other direction is inhibited and a loading space provided at an entry of the loading hole is maintained as it is.

Technical Solution

A drum magazine according to the present invention includes a wheel cover, which is configured to provide an elastic force via a mainspring to a bullet guide unit configured to elastically support a bullet loaded in a drum at a loading hole which is an inlet of the drum, rotatably disposed at an outer surface of the drum, wherein, at the time of loading, an elastic latch unit is elastically engaged with an inner ring gear of the wheel cover and allows rotation of the wheel cover only in one direction so that a loading space at an entry of the loading hole that is provided due to arbitrary rotation of the wheel cover in the one direction is maintained as it is even when a user removes his or her hand from the magazine, and after the loading is completed, a latch control unit configured to disengage the elastic latch unit and the inner ring gear is operated so that an elastic restoration force of the mainspring, which is accumulated due to the loading, is transmitted to the bullet guide unit and the loaded bullet is elastically supported at the loading hole.

Advantageous Effects

A drum magazine according to the present invention includes a wheel cover which is installed on one surface of an outer portion of a drum to provide an elastic restoration force toward a loading hole to a bullet guide unit inside the drum through rotation in one direction. The wheel cover is configured to cooperate with an elastic latch unit which is installed on one side of the drum and has a latch configured to be elastically engaged with an inner ring gear of the wheel cover to allow rotation of the wheel cover only in the one direction. Accordingly, even when the wheel cover rotates by an arbitrary angle in the one direction, a catching end of the latch is elastically engaged with the inner ring gear of the wheel cover, and thus rotation of the wheel cover in the other direction is inhibited. Therefore, there is an advantage in that, even when the user removes both hands after rotating the wheel cover in the one direction to perform loading, a loading space at an entry of the loading hole that is provided due to the rotation of the wheel cover in the one direction is maintained as it is.

Also, when the loading is completed, by use of a latch control unit configured to inhibit an elastic operation of the elastic latch unit which allows rotation of the wheel cover only in the one direction, the wheel cover is allowed to rotate in the other direction so that an elastic restoration force of a mainspring is transmitted to the bullet guide unit and a loaded bullet is elastically supported at the loading hole. With such configurations, there is an advantage in that convenience in use is improved.

DESCRIPTION OF DRAWINGS

The above and other objects, features and advantages of the present invention will become more apparent to those of ordinary skill in the art by describing exemplary embodiments thereof in detail with reference to the accompanying drawings, in which:

FIG. 1 is a perspective view of a drum magazine according to one embodiment of the present invention;

FIG. 2 is an exploded perspective view of the drum magazine of FIG. 1;

FIG. 3 is a view illustrating a configuration and an operation principle of a bullet guide unit according to the present invention;

FIG. 4 is a view illustrating configurations and operation principles of a wheel cover and an elastic latch unit according to one embodiment of the present invention;

FIG. 5 is a view illustrating configurations and operation principles of the elastic latch unit and a latch control unit according to one embodiment of the present invention;

FIG. 6 is an exploded perspective view of an elastic latch unit and a latch control unit according to another embodiment of the present invention;

FIG. 7 is a view illustrating configurations and operation principles of a wheel cover and the elastic latch unit according to another embodiment of the present invention; and FIG. 8 is a view illustrating configurations and operation principles of the elastic latch unit and the latch control unit according to another embodiment of the present invention.

MODES OF THE INVENTION

Hereinafter, the present invention will be described in detail with reference to the accompanying drawings. However, the accompanying drawings only illustrate exemplary embodiments of the present invention, and thus the scope of the present invention is not limited by the drawings. Also, even if a configuration is essential in carrying out the present invention, detailed description thereof may be omitted if the configuration belongs to a known art or can be easily implemented from a known art by those of ordinary skill in the art.

As illustrated in FIGS. 1 to 8, a drum magazine 1 according to the present invention includes a drum 10 configured to accommodate a bullet B, a bullet guide unit 20 configured to guide and support the bullet B, a wheel cover 30 configured to provide an elastic force to the bullet guide unit 20, an elastic latch unit 40 configured to allow rotation of the wheel cover 30 only in one direction, and a latch control unit 50 configured to control the operation of the elastic latch unit 40.

As in FIG. 2, the drum 10 is a structure that consists of a pair of drums 10 facing each other. A loading hole 11 through which the bullet B enters and exits is formed at one side of the drum 10 provided as the pair of drums 10, and a spiral loading groove 12 which is continuous with the loading hole 11 is disposed inside the drum 10.

An axial hole 13 which passes through the drum 10 is formed at the center of at least one of the drums 10 facing each other. Preferably, the axial hole 13 is formed to pass through one drum 10 which has one surface to which the wheel cover 30 is coupled, and an axial rotation groove 14 configured to rotatably support an end portion of a rotating shaft 21 of the bullet guide unit 20 is formed in the other drum 10. A ball bearing configured to reduce frictional resistance may be installed in the axial hole 13.

Also, a support leg 16 configured to allow the magazine 1 to stand on its own on a floor surface may be installed at a lower portion of the drum 10. The magazine 1 supported on the floor surface by the support leg 16 may stand on its own without falling even when the user removes both hands.

The bullet guide unit 20 guides and supports a plurality of bullets B added through the loading hole 11 onto the loading groove 12. The bullet guide unit 20 may include the rotating shaft 21, a length adjustment rod 22, and a guide module 23.

As in FIGS. 2 and 3, the rotating shaft 21 is rotatably coupled to the axial hole 13 of the drum 10 and has one end rotatably supported by the axial rotation groove 14 and the other end integrally coupled to an axial coupling hole 34 of the wheel cover 30 via a nut 24. At this time, preferably, the one end of the rotating shaft 21 is formed in a cylindrical shape, and the other end thereof is formed in the shape of a quadrangular column. Also, the axial coupling hole 34 is formed in a quadrangular shape to correspond to the other end of the rotating shaft 21.

The length adjustment rod 22 is formed so that the length thereof is changeable in a direction perpendicular to the rotating shaft 21. That is, an accommodating hole 21*a* is formed to pass through the rotating shaft 21 in the direction perpendicular thereto, and a plurality of rod members 22*a* and 22*b* are coupled in multiple stages inside the accommodating hole 21*a* to be able to slide and protrude.

The guide module 23 is coupled to and installed at an end portion of the length adjustment rod 22. As in FIG. 3, the guide module 23 slides along the loading groove 12 about the rotating shaft 21 in accordance with a change in the length of the plurality of rod members 22*a* and 22*b*. The guide module 23 has a structure in which a plurality of model bullets 23*a* each formed in the shape of a bullet are consecutively coupled via a link 23*b*. Here, the overall length of the guide module 23 is a length that allows the last bullet B to be supported at the loading hole 11.

Referring to FIG. 2, the wheel cover 30 includes a loading wheel 31 integrally coupled to the rotating shaft 21, which passes through the axial hole 13, on one surface of an outer portion of the drum 10, a mainspring 32 having one end coupled to and installed at the one surface of the outer portion of the drum 10 and the other end coupled to and installed at the loading wheel 31, and an inner ring gear 33 installed at an inner surface of the loading wheel 31.

With the above configurations, when the loading wheel 31 is rotated by an arbitrary angle in one direction (counterclockwise), while the mainspring 32 is wound, the guide module 23 retreats, and thus an arbitrary loading space S is formed at an entry of the loading hole 11. At this time, due to the mainspring 32, the guide module 23 is elastically supported at the loading hole 11.

The loading wheel 31 is formed in the shape of a disk that is integrally coupled to the rotating shaft 21 to integrally rotate with the rotating shaft 21, and an outer ring rim formed to be bent toward the drum 10 may be disposed at an edge of the disk.

Also, the central portion of the loading wheel 31 may be formed as a protruding end that protrudes toward the drum 10. The axial coupling hole 34 integrally coupled to the rotating shaft 21 is formed to pass through the center of the protruding end. Further, a fixing groove 35 to which the other end of the mainspring 32 is fixed is formed at one side of the protruding end.

Also, the inner ring gear 33 coupled to a latch 421 of the elastic latch unit 40, which will be described below, by being engaged therewith is formed at the inner surface of the loading wheel 31. The inner ring gear 33 is formed between the axial coupling hole 34 and the outer ring rim so that the inner ring gear 33 is able to cover a fixing slit 15 which is disposed in the outer surface of the one drum 10 and to which the one end of the mainspring 32 is fixed and coupled.

With the above configurations, as in FIG. 4, the mainspring 32 of which the one end is fixed to the fixing slit 15 of the drum 10 and the other end is fixed to the fixing groove 35 of the loading wheel 31 is placed in a space between the axial coupling hole 34 and the inner ring gear 33. By being coupled in this way, the mainspring 32 converts the rotation of the loading wheel 31 in the one direction into an elastic force and elastically supports the guide module 23 at the loading hole 11.

As in FIG. 4, the elastic latch unit 40 is installed at one side of the drum 10 and coupled to be elastically engaged with the inner ring gear 33 of the loading wheel 31 so that the elastic latch unit 40 allows the rotation of the loading wheel 31 in the one direction (counterclockwise) and inhibits the rotation thereof in the other direction (clockwise).

The elastic latch unit 40 performing the above functions may include a hole housing 41 which is formed to protrude while forming a space on the one surface of the outer portion of the drum 10 and a latch gear 42 which is configured to operate in the space of the hole housing 41. The hole housing 41 operably accommodating the latch gear 42 may be covered with a housing cover 43 to allow the latch gear 42 to stably operate in the hole housing 41.

The hole housing 41 is formed by a portion in the vicinity of an edge of the one surface of the outer portion of the drum 10 being formed as a protruding portion that protrudes. An elastic operation hole 411 and a handle operation hole 413, which are spaces in which openings are formed to be open toward the inside and outside of the respective drums 10, are formed at an inner ring and an outer ring of the protruding portion. At this time, the elastic operation hole 411 and the handle operation hole 413 are connected to a rotation operation hole 412, which is another space connecting the elastic operation hole 411 and the handle operation hole 413 to each other.

The latch gear 42 includes the latch 421 configured to elastically operate in the space of the hole housing 41 and a latch handle 423 configured to control the operation of the latch 421.

The latch 421 is installed so that one end thereof is able to rotate in the hole housing 41 about the central portion of the rotation operation hole 412 as the axis of rotation. Also, the other end of the latch 421 is elastically supported in the elastic operation hole 411 at the central portion of the outer surface of the drum 10 using a latch spring 422. However, here, the elastic operation hole 411 in which the other end of the latch 421 is elastically supported using the latch spring 422 has a structure formed of an opening that is open toward the inside of the drum 10. Thus, the other end of the latch 421 is basically formed as a catching end 421*a* that is exposed to the outside of the hole housing 41 through the opening of the elastic operation hole 411 due to an elastic supporting force of the latch spring 422.

With this configuration of the latch 421, when the loading wheel 31 rotates from the one end of the latch 421 toward the other end thereof (which is a direction of rotation identical to the rotation of the loading wheel 31 in the one direction), individual teeth of the inner ring gear 33 pass by the catching end 421*a* while pressing a back plate 421*b* of the latch 421 and eventually move over the latch 421. Then, at this time, the latch spring 422, which was elastically supporting the other end of the latch 421, is contracted while the back plate 421*b* of the latch 421 is pressed, and then, as the individual teeth of the inner ring gear 33 deviate from the latch 421, the latch spring 422 is relaxed and thus elastically supports the other end of the latch 421 again. In this case, the catching end 421*a*, which is the other end of the latch 421, is coupled to the inner ring gear 33 by being engaged therewith and thus does not serve as a catching end that inhibits rotation.

Every time each individual tooth of the inner ring gear 33 moves over the latch 421 as described above, the guide module 23 retreats by a certain amount through the rotating shaft 21 integrally coupled to the loading wheel 31, and accordingly, the loading space S in which a single bullet B may be loaded is provided at the entry of the loading hole 11. Further, in the present invention, in rotating the loading wheel 31 in the one direction, of course more than one tooth of the inner ring gear 33 may be allowed to move over the latch 421 to provide the loading space S that allows several bullets B to be added to the loading hole 11.

In the present invention, when the loading space S is provided at the entry of the loading hole 11 as described above, even when the user removes both hands from the magazine 1 according to the present invention, the loading space S is maintained as it is. As in FIG. 4, as the loading wheel 31 rotates in the one direction and the teeth of the inner ring gear 33 move over the latch 421, the latch spring 422 is elastically restored automatically and thus elastically supports the other end of the latch 421 again. Accordingly, the catching end 421*a* of the latch 421 remains exposed through the opening of the hole housing 41. In this state, when a force acts to rotate the loading wheel 31 in the other direction, the catching end 421*a* of the latch 421 and the inner ring gear 33 are coupled by being engaged with each other and block the rotation of the loading wheel 31 in the other direction. Due to such characteristics, the loading space S, which is provided at the entry of the loading hole 11 due to the rotation of the loading wheel 31 in the one direction, may be maintained as it is even when the user removes both hands from the magazine 1.

The latch handle 423 integrally extends from the one end of the latch 421 and is formed so that an exposed end, which is an end portion, is exposed to the outside of the drum 10 through the handle operation hole 413. Through operation of the exposed end of the latch handle 423, the elastic engagement and coupling of the inner ring gear 33 and the catching end 421*a* may be controlled.

That is, due to the other end of the latch 421 being elastically supported using the latch spring 422, the latch handle 423 integrally disposed at the one end of the latch 421 is disposed to be supported at one side of the handle operation hole 413 in a default state as in FIG. 4. In the default state of the latch handle 423, when the exposed end is pressed and the latch handle 423 is moved to the other side of the handle operation hole 413, the one end of the latch 421 rotates about the rotating shaft 21 and the catching end 421*a*, which is the other end of the latch 421, is accommodated in the elastic operation hole 411 of the hole housing 41, causing the latch 421 to be disposed as in FIG. 5. At this time, the latch spring 422 elastically supporting the other end of the latch 421 is in a contracted state. When the other end of the latch 421 is accommodated in the elastic operation hole 411, an accumulated elastic restoration force of the mainspring 32 acts through the rotation of the loading wheel 31 in the one direction. As described above, the elastic restoration force of the mainspring 32 is transmitted to the guide module 23 through the rotating shaft 21 and elastically pushes the loaded bullet B toward the loading hole 11 so that shooting can be performed.

In the present invention, the latch control unit 50 is installed to perform control to maintain the above-described state in which the catching end 421*a*, which is the other end of the latch 421, is accommodated in the elastic operation hole 411.

As in FIG. 5, the latch control unit 50 according to one embodiment may include a rod module 52, which is installed at one side of the drum 10 to control the engagement and coupling of the inner ring gear 33 and the latch 421, and an operation hole 51 in which the rod module 52 operates.

The operation hole 51 may include a projection/retraction hole 511 which is formed to pass through the one surface of the outer portion of the drum 10 to correspond to the elastic latch unit 40 and a hole opening 512 of which a space connected to the projection/retraction hole 511 is open toward one side surface of the drum 10.

The projection/retraction hole 511 is installed on an operation path of the latch handle 423. More specifically, the projection/retraction hole 511 is installed at a position that allows a control rod 521 of the rod module 52 to protrude through the projection/retraction hole 511 and prevent the latch handle 423 from moving from the other side of the handle operation hole 413 to the one side thereof when the catching end 421*a* of the latch 421, which is in a state in which the latch handle 423 is located at the other side of the handle operation hole 413 due to the operation of the exposed end of the latch handle 423, is accommodated in the elastic operation hole 411.

Also, the hole opening 512 formed at one side surface of the drum 10 may be formed of a two-stage opening that consists of a long opening 512*a* and a short opening 512*b* which are connected to the projection/retraction hole 511. Here, a fixing step 513 in the shape of a protruding rod may be disposed between the long opening 512*a* and the short opening 512*b*.

The rod module 52 may include the control rod 521 accommodated in the operation hole 51, a rod spring 522 configured to elastically support the control rod 521 so that the control rod 521 is accommodated in the operation hole 51, and a rod handle 523 configured to integrally protrude from the control rod 521 in a direction perpendicular thereto and be exposed through the hole opening 512.

Preferably, in the control rod 521, a projecting/retracting rod 521*b* with a reduced diameter is integrally formed with an upper end of a base rod 521*a*, which is a lower portion of the control rod 521, and the rod spring 522 is loaded on the circumference of the projecting/retracting rod 521*b*. That is, the rod spring 522 is installed to have both ends supported by the upper end of the base rod 521*a* and an inner circumferential surface of the operation hole 51 connected to the projection/retraction hole 511, and thus the rod spring 522 elastically supports the control rod 521 so that the control rod 521 is accommodated in the operation hole 51.

In the case where the projecting/retracting rod 521*b*, which is an upper end of the control rod 521, is elastically supported by the rod spring 522 and accommodated in the operation hole 51, as in FIG. 4, the rod handle 523 is located in the long opening 512*a* of the hole opening 512. In this state, the latch handle 423 blocks the projection/retraction hole 511. That is, since the other end of the latch 421 is elastically supported using the latch spring 422, the latch handle 423 is located at the one side of the handle operation hole 413 and blocks the projection/retraction hole 511. In this state, the exposed end of the latch handle 423 is pressed to push the latch handle 423 toward the other side of the handle operation hole 413, and the rod handle 523 is moved from the long opening 512*a* to the short opening 512*b* as shown in FIG. 5. Due to the fixing step 513, the rod handle 523 moved to the short opening 512*b* may remain in the state in which it is moved to the short opening 512*b*. Then, the projecting/retracting rod 521*b*, which is an upper end portion of the control rod, is exposed through the projection/retraction hole 511, and accordingly, the latch handle 423 is fixed to the other side of the handle operation hole 413. As the latch handle 423 is fixed to the other side of the handle operation hole 413, the catching end 421*a*, which is the other end of the latch 421, is accommodated in the elastic operation hole 411 and fixed. As the catching end 421*a* of the latch 421, which was coupled to the inner ring gear 33 by being engaged therewith, deviates from the inner ring gear 33, the loading wheel 31 rotates in the other direction due to the elastic restoration force of the mainspring 32 that is accumulated due to the rotation of the loading wheel 31 in the one direction. Accordingly, through the rotating shaft 21 integrally fixed to the loading wheel 31, the bullet B loaded in the guide module 23 is elastically supported at the loading hole 11 along the loading groove 12.

On the other hand, the latch control unit 50 of the present invention may be implemented according another embodiment as in FIGS. 6 to 8.

The latch control unit 50 according to the other embodiment is different from the latch control unit 50 according to the above-described embodiment in that the elastic support from the rod spring 522 acts in the opposite direction, and the hole opening 512 is formed of a single opening instead of the two openings, the long opening 512*a* and the short opening 512*b*. All the other configurations and actions are the same, and thus the latch control unit 50 according to the other embodiment will be described focusing on the rod spring 522 and the hole opening 512 formed as a single opening.

As in FIG. 6, the rod spring 522 of the latch control unit 50 according to the other embodiment is installed behind the base rod 521*a* of the control rod 521. Accordingly, the control rod 521 is elastically supported at the projection/retraction hole 511. Even when the control rod 521 is elastically supported at the projection/retraction hole 511, as in the FIG. 7, the projecting/retracting rod 521*b*, which is a distal end of the control rod 521, is exposed through the handle operation hole 413 through the projection/retraction hole 511 and does not interfere with the operation of the latch handle 423. This is because the projection/retraction hole 511 is installed within an operation range of the latch handle 423. That is, the operation range of the latch handle 423, which axially rotates according to an elastic operation of the latch spring 422 when the wheel cover 30 rotates in the one direction, has an extent that allows the latch 421 to move over the individual teeth of the inner ring gear 33, and thus the operation range is constant. Accordingly, when the projection/retraction hole 511 is installed so as not to deviate from the operation range of the latch handle 423, even when the control rod 521 is elastically supported at the projection/retraction hole 511, the projecting/retracting rod 521*b*, which is the distal end of the control rod 521, is not able to enter the handle operation hole 413 over the projection/retraction hole 511 due to being blocked by the latch handle 423.

In the above state, when the exposed end of the latch handle 423 is completely pushed toward the other side of the handle operation hole 413, as in FIG. 8, the projecting/retracting rod 521*b* of the control rod 521, which was applying an elastic force toward the projection/retraction hole 511 through the rod spring 522, is exposed through the projection/retraction hole 511. Simultaneously, the latch handle 423 is fixed to the other side of the handle operation hole 413. As the latch handle 423 is fixed to the other side of the handle operation hole 413, the catching end 421*a*, which is the other end of the latch 421, is accommodated in the elastic operation hole 411 and fixed. As the catching end 421*a* of the latch 421, which was coupled to the inner ring gear 33 by being engaged therewith, deviates from the inner ring gear 33, the loading wheel 31 rotates in the other direction due to the elastic restoration force of the mainspring 32 that is accumulated due to the rotation of the loading wheel 31 in the one direction. Accordingly, through the rotating shaft 21 integrally fixed to the loading wheel 31, the bullet B loaded in the guide module 23 is elastically supported at the loading hole 11 along the loading groove 12.

[Description of reference numerals]

| | |
|---|---|
| B: bullet | S: loading space |
| 1: magazine | |
| 10: drum | 11: loading hole |
| 12: loading groove | 13: axial hole |
| 14: axial rotation groove | 15: fixing slit |
| 16: support leg | |
| 20: bullet guide unit | 21: rotating shaft |
| 21a: accommodating hole | 22: length adjustment rod |
| 22a, 22b: rod member | 23: guide module |
| 24: nut | |
| 30: wheel cover | 31: loading wheel |
| 32: mainspring | 33: inner ring gear |
| 34: axial coupling hole | 35: fixing groove |
| 40: elastic latch unit | 41: hole housing |
| 411: elastic operation hole | 412: rotation operation hole |
| 413: handle operation hole | 42: latch gear |
| 421: latch | 421a: catching end |
| 421b: back plate | 422: latch spring |
| 423: latch handle | 43: housing cover |
| 50: latch control unit | 51: operation hole |
| 511: projection/retraction hole | 512: hole opening |
| 512a: long opening | 512b: short opening |
| 513: fixing step | 52: rod module |
| 521: control rod | 521a: base rod |
| 521b: projecting/retracting rod | 522: rod spring |
| 523: rod handle | |

The invention claimed is:

1. A drum magazine comprising:

a wheel cover (30) installed to be axially rotatable in both directions on an outer surface of a drum (10) to control movement and elastic force of a bullet guide unit (20) which is configured to guide and support a bullet (B) loaded in the drum (10);

an elastic latch unit (40) elastically supported at a central portion of the outer surface of the drum (10) so that a latch (421), which is one end portion of a latch gear (42) installed to be axially rotatable on a hole housing (41) installed at one side of the outer surface of the drum (10), elastically interferes with an inner ring gear (33) which is integrally formed with the wheel cover (30), wherein the latch gear (42) allows rotation of the wheel cover (30) in one direction through an elastic contraction operation of the latch (421) and inhibits rotation of the wheel cover (30) in another direction through the latch (421) being elastically relaxed and being coupled to teeth of the inner ring gear (33) by being engaged therewith; and a latch control unit (50) configured, for the elastic contraction operation of the latch (421) by arbitrary manipulation of an end portion of a latch handle (423), which is another end portion of the latch gear (42) and is exposed to the outside of the drum (10), to be maintained and allow rotation of the wheel cover (30) in the another direction by causing a rod module (52), which is installed to be projectable and retractable at one side of the drum (10), to interfere with the latch handle (423).

2. The drum magazine of claim 1, wherein the elastic latch unit (40) includes:

a hole housing (41) which is installed at the outer surface of the drum (10) and in which an elastic operation hole (411) and a handle operation hole (413), which have openings formed toward the inside and outside of the drum (10), respectively, are connected to a rotation operation hole (412); and the latch gear (42) which includes the latch (421), which has one end rotatably installed in the rotation operation hole (412) and another end elastically supported at the elastic operation hole (411) using a latch spring (422), and the latch handle (423) integrally extending from the one end of the latch (421) to control an elastic operation of the latch (421) through the handle operation hole (413).

3. The drum magazine of claim 2, wherein the latch control unit (50) includes:

an operation hole (51) in which, at one side, a projection and retraction hole (511) connected to an operation path of the latch handle (423) is formed in the outer surface of the drum (10), and at another side, a hole opening (512) having a long opening (512*a*) and a short opening (512*b*), which constitute a two-stage connected opening that is connected to the projection and retraction hole (511), is formed in a side surface of the drum (10); and a rod module (52) including a rod handle (523) which is installed at a control rod (521), which is elastically supported at the operation hole (51) using a rod spring (522), and exposed through the hole opening (512), wherein, when the rod handle (523) is exposed through the long opening (512*a*), it can be moved toward the short opening (512*b*) such that an upper end portion of the control rod (521) is exposed through the projection and retraction hole (511) and interferes with the latch handle (423) such that a contracted state of the latch spring (422) is fixed.

4. The drum magazine of claim 2, wherein the latch control unit (50) includes:

an operation hole (51) including a projection and retraction hole (511) which is installed at one side of the drum (10) and connected to the handle operation hole (413) and a hole opening (512) which is open in a side surface of the drum (10) to be connected to the projection and retraction hole (511); and a rod module (52) including a control rod (521) which is elastically supported at the operation hole (51) facing the handle operation hole (413) using a rod spring (522) and a rod handle (523) which is installed at the control rod (521) and exposed through the hole opening (512), wherein, when the latch handle (423) is arbitrarily manipulated so that the latch (421) is elastically contracted, through the rod spring (522) being elastically relaxed, an upper end portion of the control rod (521) is exposed through the projection and retraction hole (511) and interferes with the latch handle (423) such that a contracted state of the latch spring (422) is fixed.

5. The drum magazine of claim 1, wherein a support leg (16) configured to allow a magazine (1) to stand on its own on a floor surface is further disposed at a lower portion of the drum (10).

* * * * *